US009195999B2

(12) United States Patent
Krikorian et al.

(10) Patent No.: US 9,195,999 B2
(45) Date of Patent: Nov. 24, 2015

(54) METHODS AND SYSTEMS FOR ROUTING E-INVOICES

(71) Applicant: Mastercard International Incorporated, Purchase, NY (US)

(72) Inventors: Shari Krikorian, Armonk, NY (US); Margaret Rosen, Larchmont, NY (US)

(73) Assignee: MasterCard International Incorporated, Purchase, NY (US)

( * ) Notice: Subject to any disclaimer, the term of this patent is extended or adjusted under 35 U.S.C. 154(b) by 112 days.

(21) Appl. No.: 13/659,754

(22) Filed: Oct. 24, 2012

(65) Prior Publication Data

US 2014/0114825 A1 Apr. 24, 2014

(51) Int. Cl.
*G06Q 30/04* (2012.01)

(52) U.S. Cl.
CPC ..... *G06Q 30/04* (2013.01)

(58) Field of Classification Search
USPC ..... 705/34, 40
See application file for complete search history.

(56) References Cited

U.S. PATENT DOCUMENTS

| | | | | |
|---|---|---|---|---|
| 5,557,780 | A | 9/1996 | Edwards et al. | |
| 5,920,847 | A | 7/1999 | Kolling et al. | |
| 6,397,232 | B1 | 5/2002 | Cheng-Hung et al. | |
| 6,826,542 | B1 * | 11/2004 | Virgin et al. | 705/34 |
| 7,043,687 | B2 | 5/2006 | Knauss et al. | |
| 7,562,033 | B2 | 7/2009 | Barsade et al. | |
| 7,720,206 | B2 | 5/2010 | Devolites et al. | |
| 8,473,399 | B2 * | 6/2013 | Catahan et al. | 705/37 |
| 8,589,227 | B1 * | 11/2013 | Bridge et al. | 705/14.41 |
| 2002/0038305 | A1 * | 3/2002 | Bahl et al. | 707/100 |
| 2002/0067723 | A1 * | 6/2002 | Falys et al. | 370/389 |
| 2002/0107699 | A1 | 8/2002 | Rivera | |
| 2002/0107913 | A1 * | 8/2002 | Rivera et al. | 709/203 |
| 2003/0004874 | A1 | 1/2003 | Ludwig et al. | |
| 2003/0130942 | A1 * | 7/2003 | Campbell et al. | 705/40 |
| 2003/0229590 | A1 | 12/2003 | Byrne et al. | |
| 2004/0236651 | A1 * | 11/2004 | Emde et al. | 705/34 |
| 2006/0095374 | A1 * | 5/2006 | Lo et al. | 705/42 |
| 2007/0165801 | A1 * | 7/2007 | Devolites et al. | 379/114.03 |
| 2007/0198432 | A1 | 8/2007 | Pitroda et al. | |

(Continued)

FOREIGN PATENT DOCUMENTS

| | | | |
|---|---|---|---|
| JP | 2001306889 | A | 11/2001 |
| JP | 2003132130 | A | 5/2003 |
| KR | 120090000722 | A | 1/2009 |

OTHER PUBLICATIONS

ISR/WO PCT/US2013/066097 filed Oct. 22, 2013; mailed Feb. 7, 2014; 10 pages.

*Primary Examiner* — Luna Champagne
(74) *Attorney, Agent, or Firm* — Armstong Teasdale LLP

(57) ABSTRACT

Systems, methods, and computer-readable storage media are provided for routing electronic invoices. The computer system is in data communication with a network. The computer system is programmed to receive an electronic invoice in a first electronic invoice format via the network, translate the electronic invoice from the first electronic invoice format to an intermediary electronic invoice format, and identify, using the processor, a second electronic invoice format that is different than the first electronic invoice format. The computer system is further programmed to translate the electronic invoice from the intermediary electronic invoice format to the second electronic invoice format and transmit the electronic invoice in the second electronic invoice format via the network.

15 Claims, 5 Drawing Sheets

(56) References Cited

U.S. PATENT DOCUMENTS

| | | | | |
|---|---|---|---|---|
| 2007/0208594 | A1* | 9/2007 | Yang et al. | 705/2 |
| 2008/0008391 | A1* | 1/2008 | Geva et al. | 382/224 |
| 2009/0144166 | A1 | 6/2009 | Dickelman | |
| 2009/0319410 | A1* | 12/2009 | Kight et al. | 705/34 |
| 2010/0125521 | A1 | 5/2010 | Hanan et al. | |
| 2010/0125616 | A1 | 5/2010 | Groth | |
| 2010/0329577 | A1* | 12/2010 | Kitai | 382/218 |
| 2011/0119179 | A1* | 5/2011 | Votaw et al. | 705/40 |
| 2011/0131212 | A1* | 6/2011 | Shikha | 707/741 |
| 2012/0226823 | A1* | 9/2012 | Livnat et al. | 709/246 |
| 2013/0066663 | A1* | 3/2013 | Saito | 705/7.11 |
| 2014/0136961 | A1* | 5/2014 | Mai et al. | 715/249 |
| 2014/0164408 | A1* | 6/2014 | Dubbels | 707/755 |
| 2014/0237353 | A1* | 8/2014 | Pirvu et al. | 715/249 |

* cited by examiner

METHODS AND SYSTEMS FOR ROUTING E-INVOICES

BACKGROUND OF THE INVENTION

The field of the invention relates generally to systems and methods for processing electronic invoices and, more particularly, to network-based systems and methods for routing electronic invoices between e-invoicing providers.

Electronic invoices, or e-invoices, are invoices sent via electronic means. Some known electronic means include emailing a PDF of a traditional invoice. However, such methods merely mirror traditional paper-based systems and the efficiencies gained by using such electronic means may be slight. Other means include systems that integrate ordering, bookkeeping, and settlement systems. Such integrated systems enable e-invoices to be processed directly, perhaps without human intervention, and certainly with a reduced error rate.

Currently, e-invoicing providers enable suppliers to send e-invoices to buyers within an e-invoicing network. Within the e-invoicing network, participants use a common format for e-invoices, enabling communication among the e-invoicing network. However, different e-invoicing providers may use different e-invoice formats. Some suppliers and buyers join more than one e-invoicing network to expand the number of businesses with which those suppliers and buyers can exchange e-invoices. Joining more than one network may require using more than one e-invoicing format.

In addition to the United States having numerous e-invoicing providers, Europe currently has more than 400 e-invoicing providers, which makes joining every e-invoicing network, and communicating in all corresponding e-invoice formats, impractical. Accordingly, there is a need for a network of e-invoicing networks that provides interoperability among currently-incompatible e-invoice formats and communication among currently-disparate and independent e-invoice networks.

BRIEF DESCRIPTION OF THE INVENTION

In one embodiment, a computer system for routing electronic invoices is provided. The computer system includes a memory device and a processor. The computer system is in data communication with a network. The computer system is programmed to receive an electronic invoice in a first electronic invoice format via the network, translate the electronic invoice from the first electronic invoice format to an intermediary electronic invoice format, and identify, using the processor, a second electronic invoice format that is different than the first electronic invoice format. The computer system is further programmed to translate the electronic invoice from the intermediary electronic invoice format to the second electronic invoice format and transmit the electronic invoice in the second electronic invoice format via the network.

In another embodiment, a computer-based method for routing electronic invoices using a computer device is in data communication with a network is provided. The method includes receiving an electronic invoice in a first electronic invoice format via the network, translating the electronic invoice from the first electronic invoice format to an intermediary electronic invoice format, and identifying, using a processor, a second electronic invoice format that is different than the first electronic invoice format. The method further includes translating the electronic invoice from the intermediary electronic invoice format to the second electronic invoice format and transmitting the electronic invoice in the second electronic invoice format via the network.

In yet another embodiment, at least one non-transitory computer-readable storage media having computer-executable instructions embodied thereon is provided. When executed by at least one processor, the computer-executable instructions cause the processor to receive an electronic invoice in a first electronic invoice format via a network, translate the electronic invoice from the first electronic invoice format to an intermediary electronic invoice format, and identify, using the processor, a second electronic invoice format that is different than the first electronic invoice format. The computer-executable instructions further cause the processor to translate the electronic invoice from the intermediary electronic invoice format to the second electronic invoice format and transmit the electronic invoice in the second electronic invoice format via the network.

DETAILED DESCRIPTION OF THE INVENTION

Figure 3:
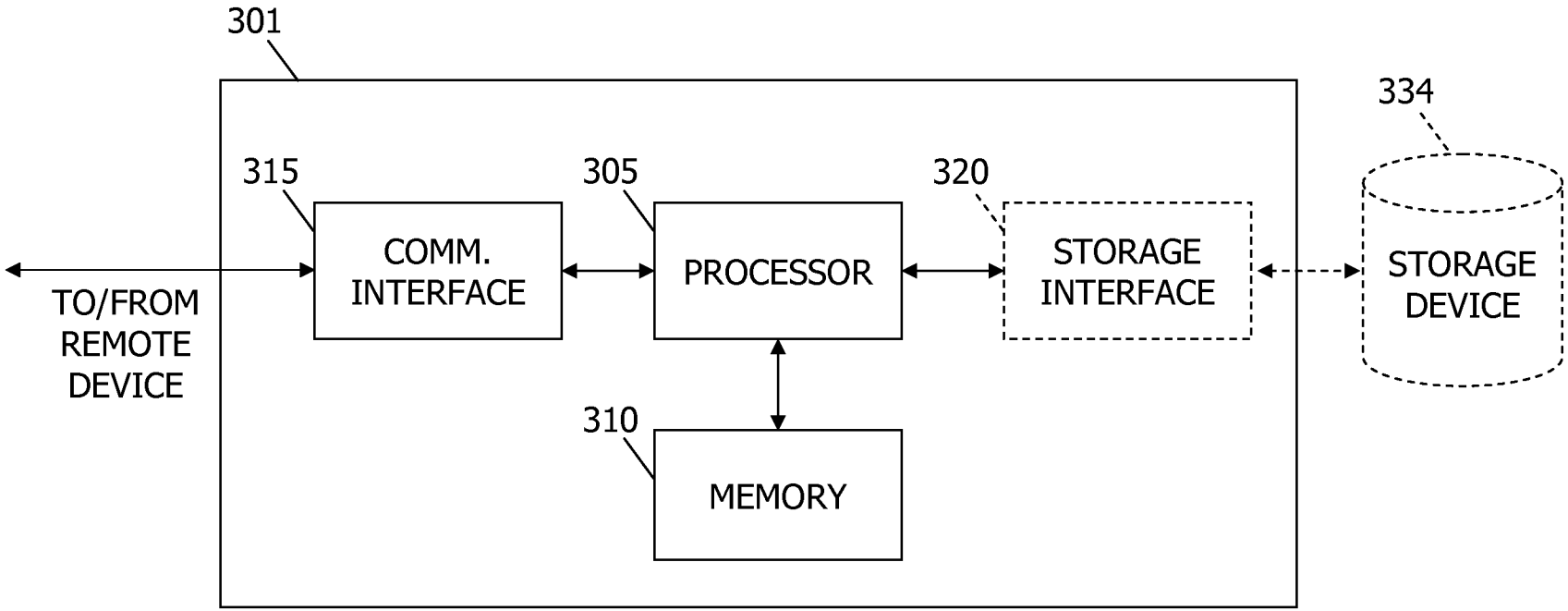
FIG. 3 illustrates an exemplary configuration of the system shown in FIG. 2.

The present disclosure is directed to routing e-invoices between two or more e-invoicing providers via a network. A system is provided that receives an e-invoice from a first e-invoicing provider in a first e-invoice format. The system translates the e-invoice into an intermediary format, and archives the e-invoice in the intermediary format within a datastore. The system determines the destination e-invoicing provider, i.e., a second e-invoicing provider, and an e-invoice format used by the second e-invoicing provider, i.e., a second e-invoice format. The system translates the e-invoice from the intermediary format into the second e-invoice format, and forwards the e-invoice to the second e-invoicing provider. Thus, e-invoices are routed between e-invoicing providers in e-invoice formats understood by the respective e-invoicing providers. FIG. 3 is used to illustrate the hardware involved in completing these steps.

A technical effect of the systems and processes described herein includes at least one of: (a) receiving an e-invoice from a first e-invoicing provider in a first e-invoice format via a network; (b) translating the e-invoice from the first e-invoice format to an intermediary e-invoice format; (c) archiving the e-invoice within a datastore; (d) identifying a destination e-invoicing provider and a destination e-invoice format; (e) translating the e-invoice from the intermediary e-invoice format to the destination e-invoice format; and (f) transmitting the e-invoice to the destination e-invoicing provider in the destination e-invoice format via the network.

In one embodiment, a computer program is provided, and the program is embodied on a computer readable medium. In an exemplary embodiment, the system is web enabled and is accessible to authorized users through the Internet. In a further exemplary embodiment, the system is being run in a Windows® environment (Windows is a registered trademark of Microsoft Corporation, Redmond, Wash.). In yet another embodiment, the system is run on a mainframe environment and a UNIX server environment (UNIX is a registered trademark of X/Open Company Limited located in Reading, Berkshire, United Kingdom). The application is flexible and designed to run in various different environments without compromising any major functionality. In some embodiments, the system includes multiple components distributed among a plurality of computing devices. One or more components may be in the form of computer-executable instructions embodied in a computer readable medium.

The systems and processes are not limited to the specific embodiments described herein. In addition, components of each system and each process can be practiced independent and separate from other components and processes described herein. Each component and process also can be used in combination with other assembly packages and processes.

Embodiments described herein access data stored in one or more data sources or databases. The terms data source and database are used interchangeably herein. A data source may include, but is not limited to: database server software (e.g., ORACLE DATABASE, MICROSOFT SQL SERVER) executing on one or more computing devices; one or more structured files; one or more text files; binary data in one or more files; one or more serialized objects; and/or one or more data lookup services, such as a web service.

The following detailed description illustrates embodiments of the invention by way of example and not by way of limitation. It is contemplated that the invention has general application to processing financial transaction data by a third party in industrial, commercial, and residential applications. As used herein, an element or step recited in the singular and proceeded with the word "a" or "an" should be understood as not excluding plural elements or steps, unless such exclusion is explicitly recited. Furthermore, references to "one embodiment" of the present invention are not intended to be interpreted as excluding the existence of additional embodiments that also incorporate the recited features.

Figure 1:
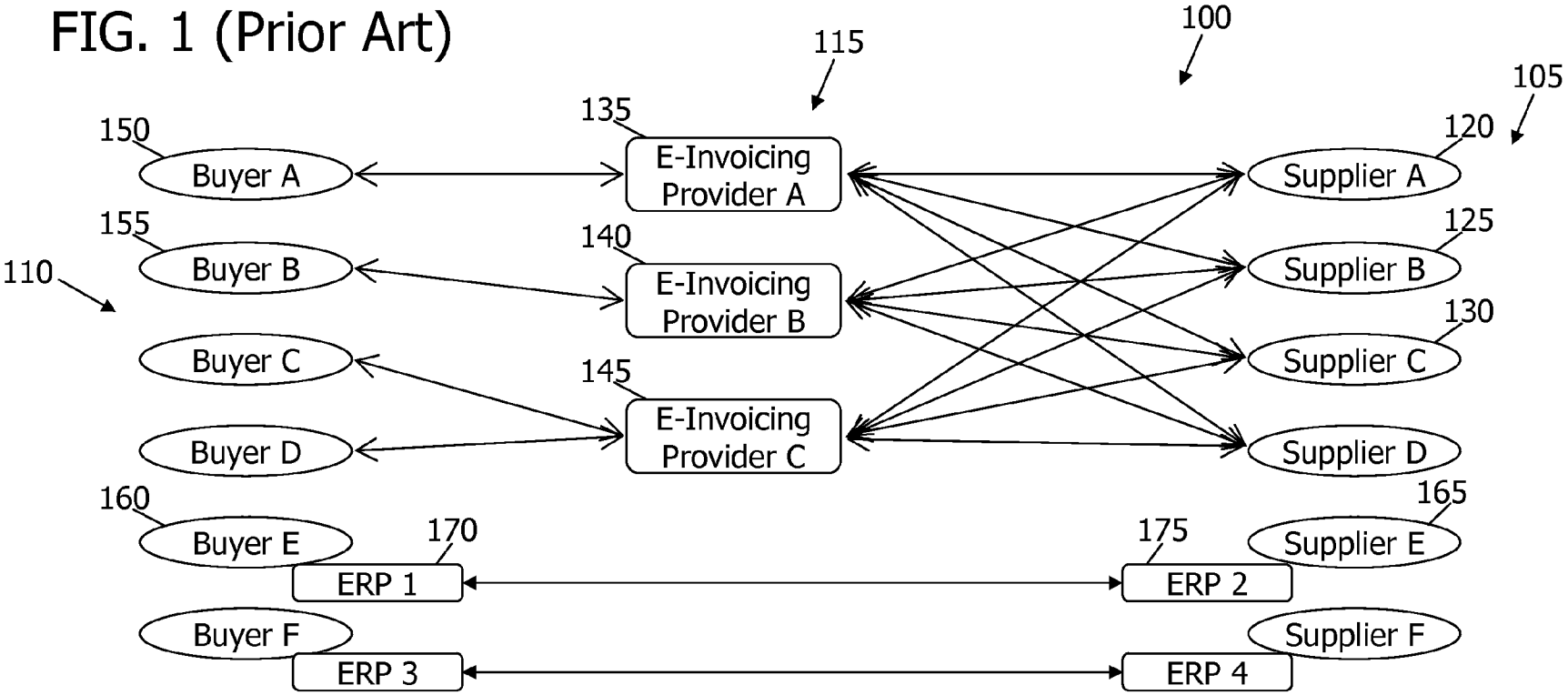
FIG. 1 (Prior Art)
FIG. 1 illustrates a conventional system for transmitting e-invoices.

FIG. 1 illustrates a conventional system 100 for transmitting e-invoices from a plurality of suppliers 105 to a plurality of buyers 110. Conventionally, e-invoices are generated and transmitted using a variety of incompatible formats and systems. E-invoices may be transmitted through a plurality of e-invoicing providers 115 that are able to communicate with suppliers 105 and buyers 110. However, due to lack of standardization and market fragmentation, e-invoicing providers 115 are not able to communicate with all suppliers and/or all buyers 110.

For example, a first, a second, and a third supplier 120, 125, and 130 may have a relationship with a first, a second, and a third e-invoicing provider 135, 140, and 145 such that suppliers 120, 125, and 130 may transmit e-invoices to e-invoicing providers 135, 140, and 145. Because each e-invoicing provider 135, 140, and 145 may use a different format for e-invoices, suppliers 120, 125, and 130 may be required to use up to three different formats for e-invoices.

In order for supplier 120 to send an e-invoice to a buyer 150, supplier 120 transmits the e-invoice to e-invoicing provider 135, which is associated with buyer 150, for forwarding to buyer 150. Similarly, in order for supplier 120 to send an e-invoice to a buyer 155, supplier 120 transmits the e-invoice to e-invoicing provider 140, which is associated with buyer 155, for forwarding to buyer 155.

In some circumstances, a buyer 160 may have a direct relationship with a supplier 165. For example, buyer 160 and supplier 165 may have agreed to a format for e-invoices and procedures for transmitting e-invoices. More particularly, buyer 160 may have an enterprise resource planning (ERP) system 170 and supplier 165 may have an ERP system 175. ERP system 175 may be configured to transmit e-invoices to ERP system 170, and ERP system 170 may be configured to automatically respond to the e-invoice. For example, ERP system 170 may submit the e-invoice to buyer 160 for approval and/or may send a payment to supplier 165.

Figure 2:
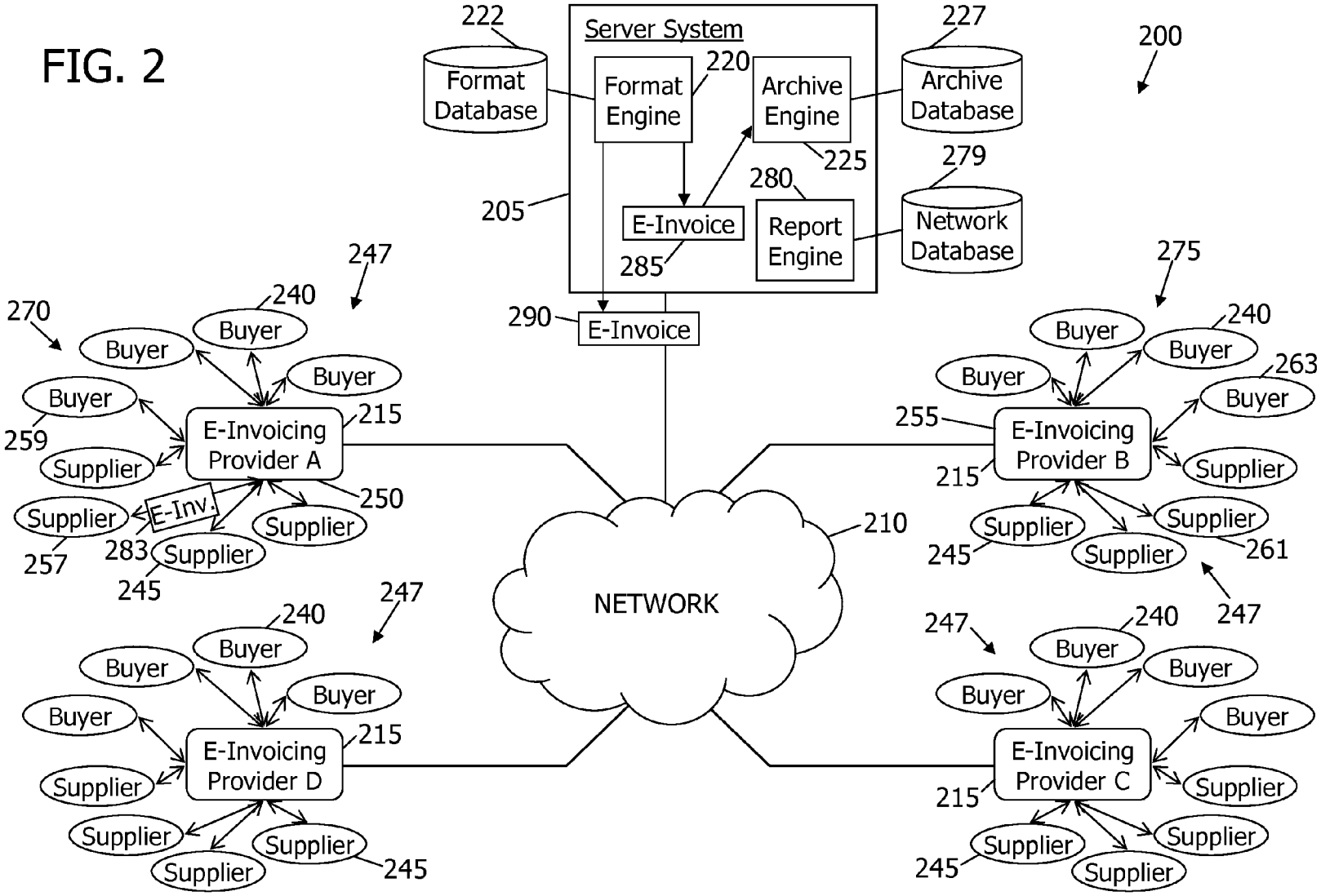
FIG. 2 is a block diagram of an exemplary system for routing e-invoices.

FIG. 2 is a block diagram of an exemplary system 200 for transmitting e-invoices having potentially incompatible formats from suppliers to buyers in accordance with one embodiment of the present invention. In the exemplary embodiment, a server system 205 is communicatively coupled to a network 210. Server system 205 may be referred to as an e-invoice router. Network 210 enables communication between server system 205 and one or more e-invoicing providers 215. Network 210 may include any number of segments and may be heterogeneous. Although a star topology is shown in FIG. 2, network 210 may use any topology and/or architecture that enables system 200 to function as described herein. For example, network 210 may include one or more WANs, LANs, dedicated links, on-demand links, VPNs, routers, and/or switches. Network 210 may also include the Internet.

Server system 205 includes a format engine 220 that is configured to receive, from e-invoicing providers 215, an e-invoice in an input format and translate the e-invoice into an output format. Format engine 220 helps facilitate interoperability between suppliers, buyers, and/or e-invoicing providers that use differently formatted e-invoices. E-invoice formatting includes, among other things, a file type and a data format specification. For example, a format may use binary files that have defined headers, data payloads, and footers. In another example, a format may use XML files constrained by a schema definition, or XSD.

In the exemplary embodiment, format engine 220 translates all incoming e-invoices into an intermediary format. Format engine 220 may accept incoming e-invoices in expected formats and/or in unexpected formats, collectively referred to as input formats. Format engine 220 may be configured to detect an input format and translate the e-invoice to the intermediary format by mapping expected data fields to corresponding data fields in the intermediary format. Alternatively, format engine 220 may parse an e-invoice to detect and extract data for use in the intermediary format. For example, format engine 220 may parse an e-invoice for expected fields and data, such as a sender/supplier name, a recipient/buyer name, a due date, an order number, payment terms, a total due, a description of goods/services provided, etc.

Format engine 220 translates e-invoices that are in the intermediary format to an output format that may be based on a destination of the e-invoice. In other words, format engine 220 accepts e-invoices in a variety of input formats, translates the e-invoices into an intermediary format, and then translates the e-invoices into an output format that is compatible with a recipient. Thus, as described in more detail herein, format engine 220 helps facilitate interoperability between e-invoice providers 115.

In the exemplary embodiment, expected input formats, the intermediary format, and output formats are stored in a format datastore 222. Format datastore 222 may include a database, flat files, and/or any data storage that enables format engine 220 to function as described herein. Format datastore 222 is accessible by server system 205 and may be internal and/or external to server system 205. A mapping of data fields in expected input formats may be stored in a mapping definition within format datastore 222. For example, if the expected format is XML, a mapping definition may be stored as an extensible stylesheet language transformation (XSLT). Rules and schemas defining an output format may likewise be stored in an output definition within format datastore 222.

Server system 205 also includes an archive engine 225 configured to store e-invoices received by server system 205. More particularly, e-invoices may be stored in an archive datastore 227 accessible by server system 205. Archive datastore 227 may be internal or external to server system 205. In the exemplary embodiment, e-invoices are stored in archive datastore 227 in the intermediary format. Additionally, the received e-invoice, in an input format, and/or the transmitted e-invoice, in an output format, may be stored in archive datastore 227.

Each e-invoicing provider 215 is communicatively coupled to one or more buyers 240 and one or more suppliers 245 within an e-invoice network 247. E-invoice network 247 includes suppliers 245, buyers 240, and e-invoicing provider 215. Similarly to the conventional system shown in FIG. 1, each e-invoicing provider 215 facilitates transmission of e-invoices from suppliers 245 to buyers 240. Each e-invoicing provider 215 may employ a different format for e-invoices that is incompatible with one or more other e-invoicing providers 215. For example, a first e-invoicing provider 250 may use an e-invoice format incompatible with a second e-invoicing provider 255. More particularly, a supplier 257 may send an e-invoice in a first format to a buyer 259 via e-invoicing provider 250, and a supplier 261 may send an e-invoice in a second format to a buyer 263 via e-invoicing provider 255.

Server system 205 enables e-invoices to be sent from supplier 257, in a first e-invoice network 270, to buyer 263, in a second e-invoice network 275. More particularly, server system 205 is configured to receive an e-invoice from supplier 257 in an input format and translate the e-invoice into an intermediary format, as described herein. E-invoicing provider 215 may be configured to determine whether an e-invoice can be sent to a recipient directly via e-invoicing network 247 or whether the e-invoice needs to be routed to the recipient via server system 205. In order for server system 205 to determine an appropriate output format, server system 205 is configured to determine the e-invoicing provider associated (i.e., in the same e-invoicing network 270) with buyer 263.

System 200 includes a network datastore 279 that may be coupled to, or a component of, server system 205. Network datastore 279 enables server system 205 to "look up" the e-invoicing provider associated with a provided buyer (i.e., in an e-invoice). Accordingly, network datastore 279 includes a data collection that associates buyers 240 and corresponding e-invoicing providers 215. Moreover, network datastore 279 may include all suppliers 245 and any other node reachable via network 210. Network datastore 279 may be used by server system 205 to provide a directory of accessible parties and nodes. Server system 205 is configured to determine, using an e-invoice and network datastore 279, the e-invoicing provider associated with the buyer specified in the e-invoice. Moreover, server system 205 is configured to determine, using the determined e-invoicing provider and format datastore 222, an output format compatible with the determined e-invoice provider. Server system 205 is further configured to translate the e-invoice from supplier 257 to the determined output format and to forward the e-invoice, in the determined output format, to e-invoicing provider 255 for delivery to buyer 263.

Server system 205 may also include a report engine 280. Report engine 280 is configured to receive report requests from suppliers 245 and/or buyers 240. Report engine 280 generates reports based on one or more e-invoices associated with the requester. For example, report engine 280 may generate a value added tax (VAT) report. Requests to and reports from report engine 280 may be transmitted using network 210. The content and format of reports generated by report engine 280 may be determined or customized by buyers 240, suppliers 245, and/or e-invoicing providers 115.

During operation, an e-invoice 283 is generated and transmitted by supplier 257 to e-invoicing provider 250. E-invoice 283 includes a sender (supplier 257), a recipient (buyer 263), and invoice data, and is in a first format. Upon receiving e-invoice 283, e-invoicing provider 250 determines that the recipient of e-invoice 283 is not within e-invoicing network 270. In other words, e-invoicing provider 250 has no relationship with, nor the ability to directly communicate e-invoices to, buyer 263. Having determined that e-invoice 283 cannot be transmitted directly to buyer 263, e-invoicing provider 250 forwards e-invoice 283 to server system 205 via network 210.

Upon receiving e-invoice 283, server system 205 passes e-invoice 283 to format engine 220 for format translation. Format engine 220 determines how to translate e-invoice 283, in the first format, to an intermediary format. In the exemplary embodiment, format datastore 222 enables format engine 220 to recognize the first format and to translate e-invoice 283 into the intermediary format. Alternatively, format engine 220 parses e-invoice 283 for pre-determined data fields and populates an e-invoice in the intermediary format. Regardless of how format engine 220 translates e-invoice 283 into the intermediary format, data previously in the first format is placed into the intermediary format.

Format engine 220 generates an e-invoice 285 based on e-invoice 283 and in the intermediary format. E-invoice 285 is archived by archive engine 225 in archive datastore 227. Server system 205 determines, using network datastore 279, a destination e-invoicing provider (i.e., e-invoicing provider 255) based on buyer 263. As the destination e-invoicing provider may dictate a destination or output format, server system 205 determines, using format datastore 222 and/or format engine 220, the destination format based on the destination e-invoicing provider. Format engine 220 translates e-invoice 285, in the intermediary format, to an e-invoice 290, in the destination format. Server system 205 transmits e-invoice 290 to e-invoicing provider 255 via network 210. E-invoicing provider forwards e-invoice 290 to buyer 263.

FIG. 3 illustrates an exemplary configuration of a server computing device 301 such as server system 205 (shown in FIG. 2). Buyers 240, suppliers 245, and/or e-invoicing providers 215 may include a server computing device 301. Server computing device 301 includes a processor 305 for executing instructions. Instructions may be stored in a memory area 310, for example. Processor 305 may include one or more processing units (e.g., in a multi-core configuration).

Processor 305 is operatively coupled to a communication interface 315 such that server computing device 301 is capable of communicating with a remote device such as e-invoicing providers 215 via network 210. For example, communication interface 315 may send/receive e-invoices to/from e-invoicing provider 250, e-invoicing provider 255, buyer 259, and supplier 261, as illustrated in FIG. 2.

Processor 305 may also be operatively coupled to a storage device 334. Storage device 334 is any computer-operated hardware suitable for storing and/or retrieving data. In some embodiments, storage device 334 is integrated in server computing device 301. For example, server computing device 301 may include one or more hard disk drives as storage device 334. In other embodiments, storage device 334 is external to server computing device 301 and may be accessed by a plurality of server computing devices 301. For example, storage device 334 may include multiple storage units such as hard disks or solid state disks in a redundant array of inexpensive disks (RAID) configuration. Storage device 334 may include a storage area network (SAN) and/or a network attached storage (NAS) system.

In some embodiments, processor 305 is operatively coupled to storage device 334 via a storage interface 320. Storage interface 320 is any component capable of providing processor 305 with access to storage device 334. Storage interface 320 may include, for example, an Advanced Technology Attachment (ATA) adapter, a Serial ATA (SATA) adapter, a Small Computer System Interface (SCSI) adapter, a RAID controller, a SAN adapter, a network adapter, and/or any component providing processor 305 with access to storage device 334.

Server system 205 may include one or more server computing devices 301, which may be heterogeneous and diverse. Server system 205 may be distributed over a plurality of server computing devices 301 in one or more datacenters. Each engine 220, 225, and 280 (shown in FIG. 2) may be implemented in a single server computing device 301 or a plurality of server computing devices 301. Likewise, datastores 222, 227, and 279 may be implemented in a single storage device 334, whether integrated with server computing device 301 or remotely connected, or as a single server computer device 301 or a plurality of server computing devices 301.

As used herein, the terms "software" and "firmware" are interchangeable, and include any computer program stored in memory for execution by personal computers, workstations, clients and servers, including random access memory (RAM), read-only memory (ROM), erasable programmable ROM (EPROM), electrically erasable programmable ROM (EEPROM), and/or non-volatile RAM (NVRAM) memory. The above memory types are exemplary only, and are thus not limiting as to the types of memory usable for storage of a computer program.

Figure 4:
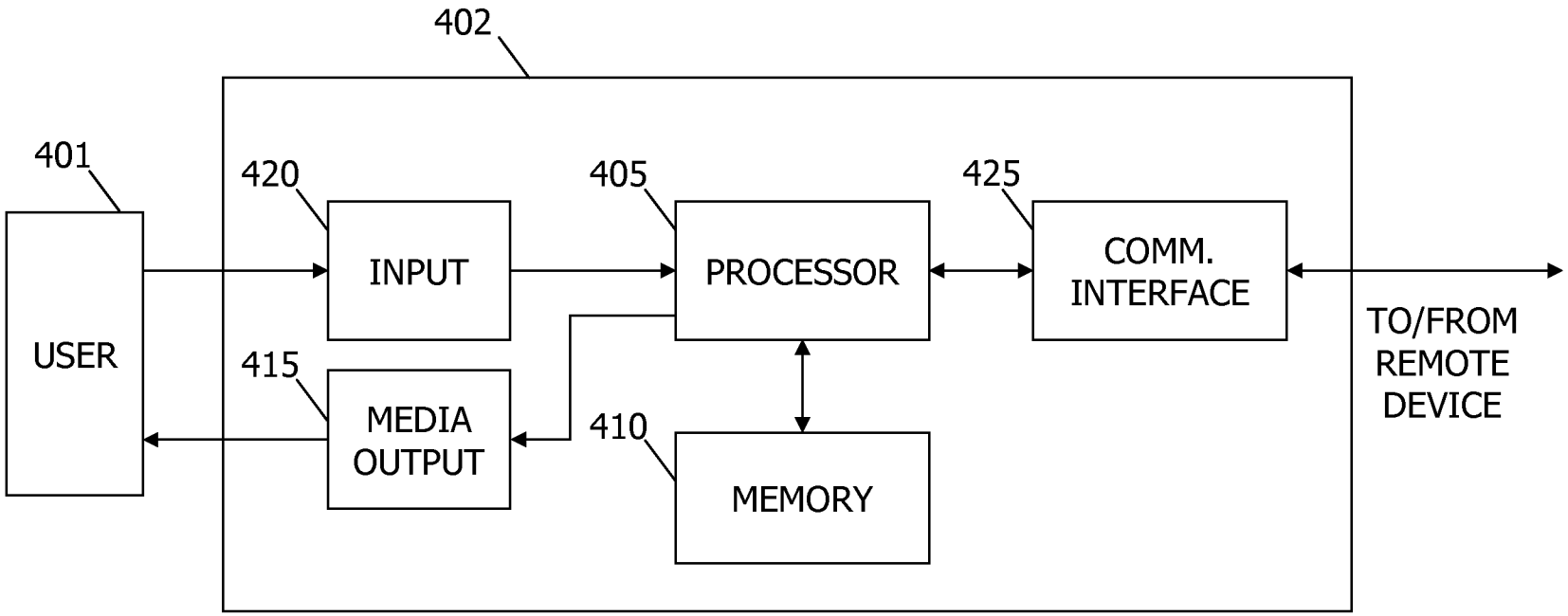
FIG. 4 illustrates an exemplary configuration of a user computing device for use with the system shown in FIG. 2.

FIG. 4 illustrates an exemplary configuration of a user computing device 402 operated by a user 401. User computing device 402 may include, but is not limited to, buyers 240 and suppliers 245.

User computing device 402 includes a processor 405 for executing instructions. In some embodiments, executable instructions are stored in a memory area 410. Processor 405 may include one or more processing units (e.g., in a multicore configuration). Memory area 410 is any device allowing information such as executable instructions and/or written works to be stored and retrieved. Memory area 410 may include one or more computer readable media.

User computing device 402 also includes at least one media output component 415 for presenting information to user 401. Media output component 415 is any component capable of conveying information to user 401. In some embodiments, media output component 415 includes an output adapter such as a video adapter and/or an audio adapter. An output adapter is operatively coupled to processor 405 and operatively couplable to an output device such as a display device (e.g., a liquid crystal display (LCD), organic light emitting diode (OLED) display, or "electronic ink" display) or an audio output device (e.g., a speaker or headphones).

In some embodiments, user computing device 402 includes an input device 420 for receiving input from user 401. Input device 420 may include, for example, a keyboard, a pointing device, a mouse, a stylus, a touch sensitive panel (e.g., a touch pad or a touch screen), a gyroscope, an accelerometer, a position detector, or an audio input device. A single component such as a touch screen may function as both an output device of media output component 415 and input device 420.

User computing device 402 may also include a communication interface 425, which is communicatively coupleable to a remote device such as server system 205. Communication interface 425 may include, for example, a wired or wireless network adapter or a wireless data transceiver for use with a mobile phone network (e.g., Global System for Mobile communications (GSM), 3G) or other mobile data network (e.g., Worldwide Interoperability for Microwave Access (WIMAX)).

Stored in memory area 410 are, for example, computer readable instructions for providing a user interface to user 401 via media output component 415 and, optionally, receiving and processing input from input device 420. A user interface may include, among other possibilities, a web browser and client application. Web browsers enable users, such as user 401, to display and interact with media and other information typically embedded on a web page or a website from server system 205. A client application allows user 401 to interact with a server application from server system 205.

Figure 5:
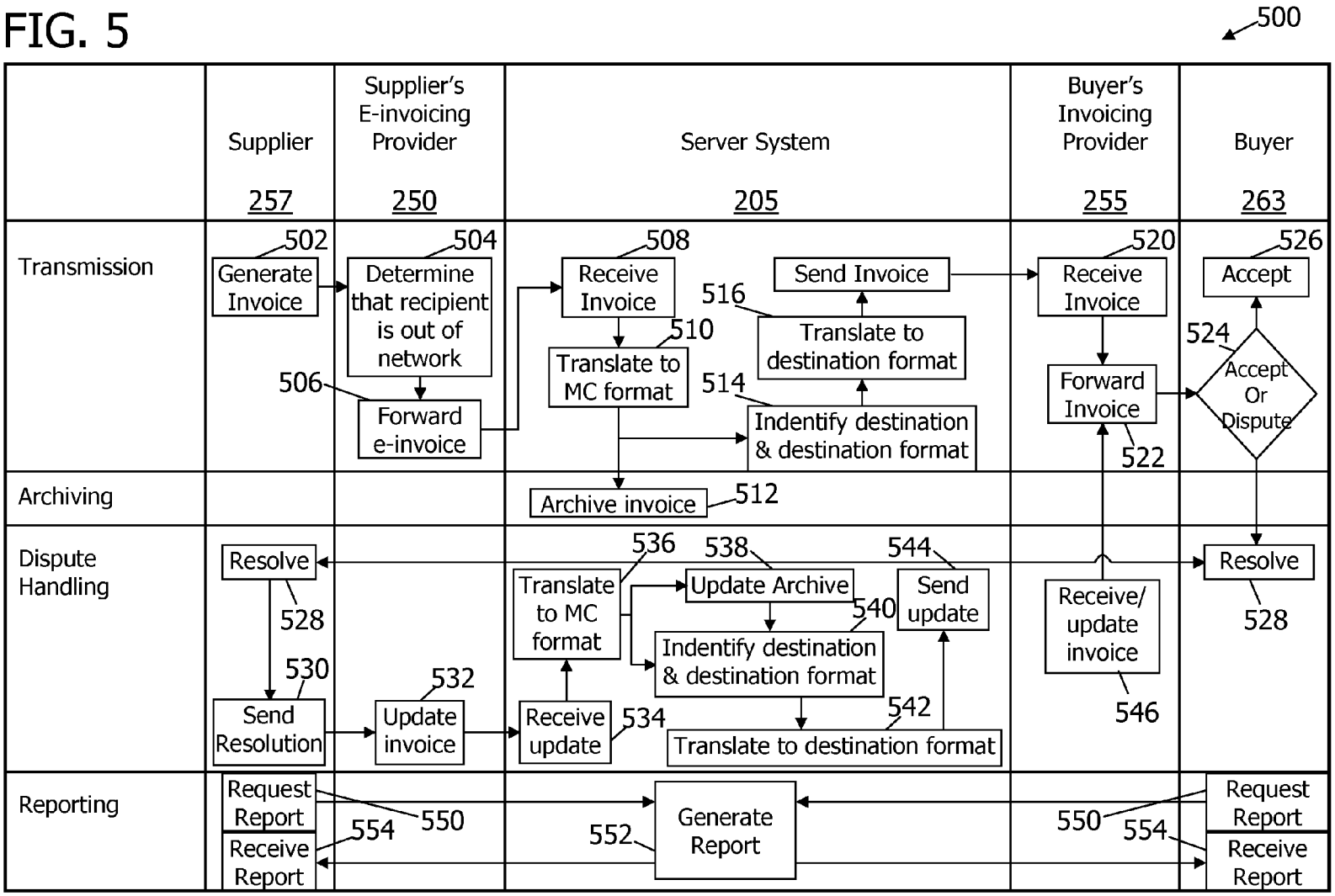
FIG. 5 is a diagram of an exemplary method for routing an e-invoice using the system shown in FIG. 2.

FIG. 5 is a swimlane diagram illustrating an exemplary method 500 for routing an e-invoice having potentially incompatible formats using the system shown in FIG. 2. Referring to FIG. 2, server system 205 achieves the technical effect by implementing method 500. Initially, supplier 257 generates 502 an e-invoice. Although FIG. 5 illustrates the e-invoice being generated at supplier 257, the e-invoice may also be generated at e-invoicing provider 250 at the request of supplier 257. For example, supplier 257 may, using a web site provided by e-invoicing provider 250, generate the e-invoice by providing the e-invoice data to the web site. E-invoicing provider 250 receives the e-invoice and determines 504 that the recipient of the e-invoice (i.e., buyer 263), is outside of e-invoice network 270. E-invoicing provider 250 forwards 506 the e-invoice to server system 205. E-invoicing provider 250 may alter the e-invoice before forwarding 506.

Server system 205 receives 508 the e-invoice, which is in an input format. Server system 205 translates 510 the e-invoice into an intermediary format. More particularly, server system 205 may translate 510 the e-invoice using format engine 220 and based on a mapping definition stored in format datastore 222, shown in FIG. 2. Server system 205 archives 512 the e-invoice, in the intermediary format, in archive datastore 227 using archive engine 225, shown in FIG. 2.

Server system 205 identifies 514 a destination of the e-invoice based on the recipient and using network datastore 280. More particularly, server system 205 identifies buyer 263 and an e-invoicing provider associated with buyer 263 (i.e., e-invoicing provider 255). Based on the identified e-invoicing provider, server system 205 identifies an output format using format engine 220 and/or format datastore 222. Server system 205 then translates 516 the e-invoice into the output format. Server system sends 518 the e-invoice, in the output format, to e-invoicing provider 255.

E-invoicing provider 255 receives 520 the e-invoice and forwards 522 the e-invoice to buyer 263. Forwarding 522 the e-invoice may include transmitting the e-invoice to buyer 263, making the e-invoice available to buyer 263, e.g., on a website, and/or any method of sending the e-invoice to buyer 263. Buyer 263 determines 524 whether to accept or dispute the e-invoice. If buyer 263 accepts 526 the e-invoice, buyer 263 pays supplier 257 an amount specified by the e-invoice. However, if buyer 263 disputes the e-invoice, buyer 263 and supplier 257 resolve 528 the dispute. The dispute may be resolved 528 using any means or method of communication.

After resolving 528 the dispute over the e-invoice, supplier 257 sends 530 a resolution to server system 205. The resolution includes the change to the e-invoice that supplier 257 agreed to in order to resolve 528 the dispute. In the exemplary embodiment, the resolution causes the disputed e-invoice to be updated 532 by supplier's e-invoicing provider 250. Alternatively, the resolution is an e-invoice that includes a reference to a previous e-invoice that is superseded by the resolution. Server system 205 receives 534 the updated e-invoice and translates 536 the updated e-invoice into the intermediary format. The e-invoice archive is updated 538 to reflect the change in the updated e-invoice. The original, as well as the updated, e-invoice may be stored.

Server system 205 identifies 540 a destination of the e-invoice based on the recipient and using network datastore 280. More particularly, server system 205 identifies buyer 263 and an e-invoicing provider associated with buyer 263 (i.e., e-invoicing provider 255). Based on the identified e-invoicing provider, server system 205 identifies an output format using format engine 220 and/or format datastore 222. Server system 205 then translates 542 the e-invoice into the output format. Server system sends 544 the e-invoice, in the output format, to e-invoicing provider 255.

Buyer's e-invoicing provider 255 receives 546 the updated e-invoice and forwards 522 the e-invoice to buyer 263. Supplier 257 and/or buyer 263 may request 550 a report, e.g., a VAT report, a summary report on e-invoices sent and/or received in a specified time period, a status report on pending e-invoices, etc. Server system 205 generates 552 requested reports and transmits the reports to the requester, who receives 554 the reports. In the exemplary embodiment, report requests and reports are transmitted via e-invoicing networks 247. Alternatively, or additionally, direct communication of report requests and reports between supplier 257, buyer 263, and server system 205 may be facilitated by a web interface provided by server system 205.

The systems and processes described herein enable system 200 to facilitate interoperability between and among e-invoicing providers and associated suppliers and buyers. By using system 200, suppliers are able to reach a greater number of buyers with e-invoices while not being required to transmit an e-invoice in the format of the buyers. System 200 forms a network of e-invoicing networks and provides routing, translation, and storage of e-invoices transmitted across the network. System 205 facilitates creating and making accessible a directory of buyers available via system 200. The current market fragmentation of e-invoicing providers has slowed adoption of e-invoicing, which is more efficient than paper-based systems. System 200, including server system 205 and network 210, overcomes the challenges of market fragmentation by enabling otherwise-incompatible e-invoicing providers to communicate e-invoices.

The systems and processes are not limited to the specific embodiments described herein. In addition, components of each system and each process can be practiced independent and separate from other components and processes described herein. Each component and process also can be used in combination with other assembly packages and processes. For example, suppliers 245 and buyers 240 may communicate e-invoices directly with server system 205 via network 210.

Having described aspects of the invention in detail, it will be apparent that modifications and variations are possible without departing from the scope of aspects of the invention as defined in the appended claims. As various changes could be made in the above constructions, products, and methods without departing from the scope of aspects of the invention, it is intended that all matter contained in the above description and shown in the accompanying drawings shall be interpreted as illustrative and not in a limiting sense. For example, the buyer may be a consumer or a business entity and/or the supplier may be an individual or a business entity. Thus, while business-to-business transactions are used as an example throughout, it is contemplated that personal and/or non-business transactions may be executed according to the embodiments described herein.

A computer device, such as those described herein, includes at least one processor or processing unit and a system memory. The computer device typically has at least some form of computer readable media. By way of example and not limitation, computer readable media include computer storage media and communication media. Computer storage media include volatile and nonvolatile, removable and non-removable physical media implemented in any method or technology for storage of information such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art are familiar with the modulated data signal, which has one or more of its characteristics set or changed in such a manner as to encode information in the signal. Combinations of any of the above are also included within the scope of computer readable media.

The methods described herein may be encoded as executable instructions embodied in a computer readable medium, including, without limitation, a computer storage medium, a storage device, and/or a memory device. Such instructions, when executed by a processor, cause the processor to perform at least a portion of the methods described herein.

Embodiments may be described in the general context of computer-executable instructions, such as program components or modules, executed by one or more computers, processors, and/or other devices. Aspects of the invention may be implemented with any number and organization of components or modules. For example, embodiments are not limited to the specific computer-executable instructions or the specific components or modules illustrated in the figures and described herein. Alternative embodiments may include different computer-executable instructions or components having more or less functionality than illustrated and described herein.

The order of execution or performance of the operations in the embodiments illustrated and described herein is not essential, unless otherwise specified. That is, the operations may be performed in any order, unless otherwise specified, and embodiments may include additional or fewer operations than those disclosed herein. For example, it is contemplated that executing or performing a particular operation before, contemporaneously with, or after another operation is within the scope of the described embodiments.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated processes. The patentable scope of the invention is defined by the claims, and may include other examples that occur to those skilled in the art. These other examples are intended to be within the scope of the claims if they have structural elements that do not differ from the literal language of the claims, or if they include equivalent structural elements with insubstantial differences from the literal languages of the claims.

While the invention has been described in terms of various specific embodiments, those skilled in the art will recognize that the invention can be practiced with modification within the spirit and scope of the claims.

The invention claimed is:

1. A computer system for routing electronic invoices, said computer system comprising a memory device and a processor, said computer system in data communication with a communication network, said computer system programmed to:

receive an electronic invoice in a first electronic invoice format via the communication network from a first e-invoicing provider that transmits electronic invoices between a first plurality of electronic invoice senders and recipients via a first electronic invoicing network;

recognize the first electronic invoice format using a defined header, a defined data payload, and a defined footer in at least one format file of a plurality of format files stored in a format datastore in the memory device;

translate, using a format engine, the electronic invoice into an intermediary electronic invoice format;

extract an identifier of a specified recipient from the electronic invoice;

perform a lookup, using a network datastore, for a second e-invoicing provider included within a second electronic invoicing network and associated with the specified recipient identifier, the second electronic invoicing network being different from the first electronic invoicing network;

retrieve, using the format datastore, a second electronic invoice format that is associated with the second e-invoicing provider;

translate, using the format engine, the electronic invoice from the intermediary electronic invoice format to the second electronic invoice format; and transmit the electronic invoice in the second electronic invoice format via the communication network to the second e-invoicing provider for transmission to the specified recipient via the second electronic invoicing network, wherein the second e-invoicing provider transmits electronic invoices between a second plurality of electronic invoice senders and recipients.

2. A system in accordance with claim 1, wherein said computer system is further programmed to archive the electronic invoice in the intermediary electronic invoice format within a datastore.

3. A system in accordance with claim 1, wherein the network datastore includes data that associates each recipient to a corresponding e-invoicing provider.

4. A system in accordance with claim 3, wherein the format datastore includes at least one electronic invoice format associated with each e-invoicing provider, a mapping of data fields in expected input formats, and rules and schemas defining expected output formats.

5. A system in accordance with claim 4, wherein said computer system is further programmed to transmit the electronic invoice to the second e-invoicing provider via the communication network and an e-invoicing network that is communicatively coupled to the communication network.

6. A system in accordance with claim 1, wherein said computer system is further programmed to generate a report based on the electronic invoice.

7. A computer-based method for routing electronic invoices using a computer device in data communication with a communication network, said method comprising:

receiving an electronic invoice in a first electronic invoice format via the communication network from a first e-invoicing provider that transmits electronic invoices between a first plurality of electronic invoice senders and recipients via a first electronic invoicing network;

recognizing the first electronic invoice format using at least one of a defined header, a defined data payload, and a defined footer in at least one format file of a plurality of format files stored in a format datastore in the memory device;

translating, using a format engine, the electronic invoice into an intermediary electronic invoice format;

extracting an identifier of a specified recipient from the electronic invoice;

performing a lookup, using a network datastore, for a second e-invoicing provider included within a second electronic invoicing network and associated with the specified recipient identifier, the second electronic invoicing network being different from the first electronic invoicing network;

retrieve, using the format datastore, a second electronic invoice format that is associated with the second e-invoicing provider;

translating the electronic invoice from the intermediary electronic invoice format to the second electronic invoice format; and transmitting the electronic invoice in the second electronic invoice format via the communication network to the second e-invoicing provider for transmission to the specified recipient via the second electronic invoicing network, wherein the second e-invoicing provider transmits electronic invoices between a second plurality of electronic invoice senders and recipients.

8. A method in accordance with claim 7, further comprising archiving the electronic invoice in the intermediary electronic invoice format within a datastore.

9. A method in accordance with claim 7, wherein the network datastore includes data that associates each recipient to a corresponding e-invoicing provider.

10. A method in accordance with claim 9, wherein retrieving the second electronic invoice format comprises, accessing the format datastore that includes at least one electronic invoice format associated with each e-invoicing provider, a mapping of data fields in expected input formats, and rules and schemas defining expected output formats.

11. A method in accordance with claim 10, wherein transmitting the electronic invoice comprises transmitting the electronic invoice to the second e-invoicing provider via the communication network and an e-invoicing network that is communicatively coupled to the network.

12. At least one non-transitory computer-readable storage media having computer-executable instructions embodied thereon, wherein when executed by at least one processor, the computer-executable instructions cause the processor to:

receive an electronic invoice in a first electronic invoice format via a communication network from a first e-invoicing provider that transmits electronic invoices between a first plurality of electronic invoice senders and recipients via a first electronic invoicing network;

recognize the first electronic invoice format using at least one of a defined header, a defined data payload, and a defined footer in at least one format file of a plurality of format files stored in a format datastore in the memory device;

translate, using a format engine, the electronic invoice into an intermediary electronic invoice format;

extract an identifier of a specified recipient from the electronic invoice;

perform a lookup, using a network datastore, for a second e-invoicing provider included within a second electronic invoicing network and associated with the specified recipient identifier, the second electronic invoicing network being different from the first electronic invoicing network;

retrieve, using the format datastore, a second electronic invoice format that is associated with the second e-invoicing provider;

translate, using the format engine, the electronic invoice from the intermediary electronic invoice format to the second electronic invoice format; and transmit the electronic invoice in the second electronic invoice format via the communication network to a second e-invoicing provider for transmission to the specified recipient via the second electronic invoicing network, wherein the second e-invoicing provider transmits electronic invoices between a second plurality of electronic invoice senders and recipients.

13. The computer-readable storage media of claim 12, wherein the computer-executable instructions further cause the processor to archive the electronic invoice in the intermediary electronic invoice format within a datastore.

14. The computer-readable storage media of claim 12, wherein the the network datastore includes data that associates each recipient to a corresponding e-invoicing provider.

15. The computer-readable storage media of claim 14, wherein the computer-executable instructions further cause the processor to access the format datastore including at least one electronic invoice format associated with each e-invoicing provider, a mapping of data fields in expected input formats, and rules and schemas defining expected output formats.

* * * * *